United States Patent [19]

Kulp et al.

[11] Patent Number: 4,980,984

[45] Date of Patent: Jan. 1, 1991

[54] HIGHWAY SIGNS AND FLAGS CAPABLE OF BEING ROLLED UP

[75] Inventors: Jack H. Kulp, San Juan Capistrano; John D. McKenney, South Laguna, both of Calif.

[73] Assignee: Traffic Devices, Inc., San Clemente, Calif.

[21] Appl. No.: 404,111

[22] Filed: Sep. 7, 1989

[51] Int. Cl.[5] ..... G09F 15/00

[52] U.S. Cl. ..... 40/610; 40/612

[58] Field of Search ..... 40/607, 610, 603, 612, 40/608, 611; 116/63 P

[56] References Cited

U.S. PATENT DOCUMENTS

| | | | |
|---|---|---|---|
| 4,426,800 | 1/1984 | Brown | 40/610 |
| 4,490,934 | 1/1985 | Knapp | 40/610 |
| 4,569,499 | 2/1986 | Seely | 40/608 |
| 4,619,220 | 10/1986 | Seely et al. | 40/603 |
| 4,691,892 | 9/1987 | Grewe et al. | 40/611 |
| 4,888,894 | 12/1989 | Brown, Jr. | 40/602 |

*Primary Examiner*—Peter R. Brown
*Assistant Examiner*—James M. Gardner
*Attorney, Agent, or Firm*—Edward J. DaRin

[57] ABSTRACT

A flexible highway safety sign capable of being rolled up for storage and portability and mounting a high-way flag. The safety sign is useful with flexible frame members that allow the mounted sign to bend in response to winds and wind gusts without tipping over and taking a set. The frame members include a clamping assembly for mounting a plurality of flag arms with the highway sign. The clamping assembly permits a pair of flag arms to be pivotally secured thereto between a flat displaying position and a storage position. The storage position allows the flag arms to assume a side-by-side relationship with the folded frame members to the sign to permit the flexible sign to be wreapped around the members for storage and/or transport.

16 Claims, 2 Drawing Sheets

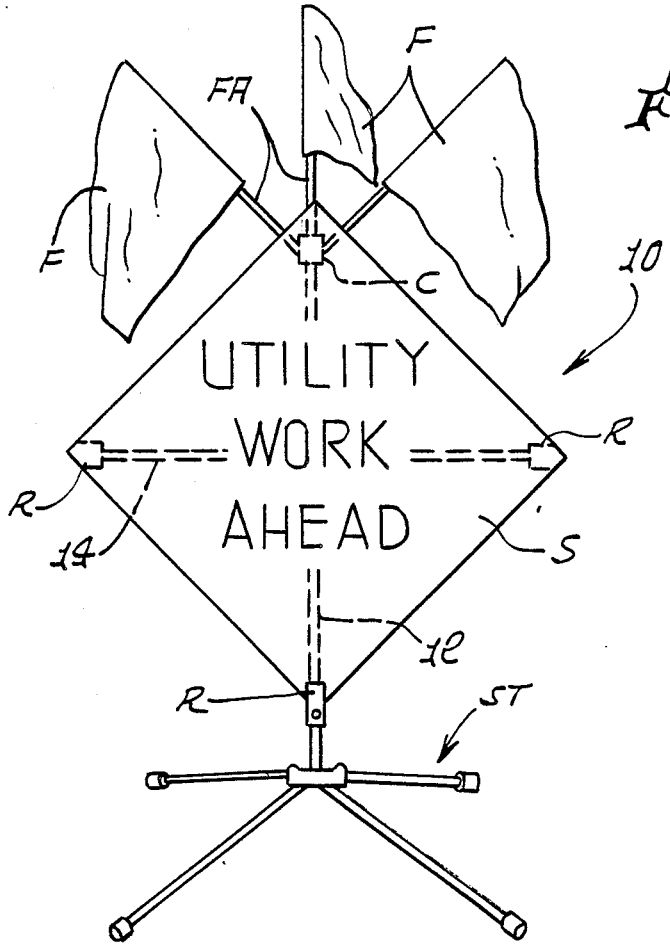
FIG. 1.
FIG. 2.
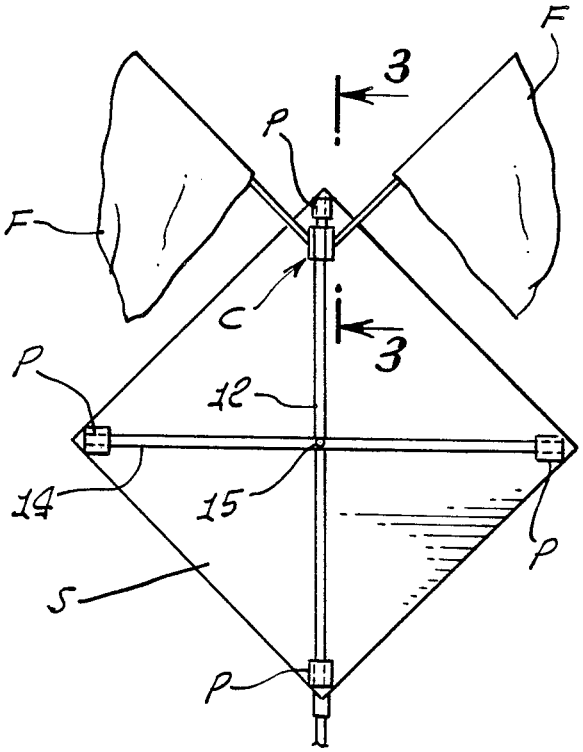
FIG. 3.
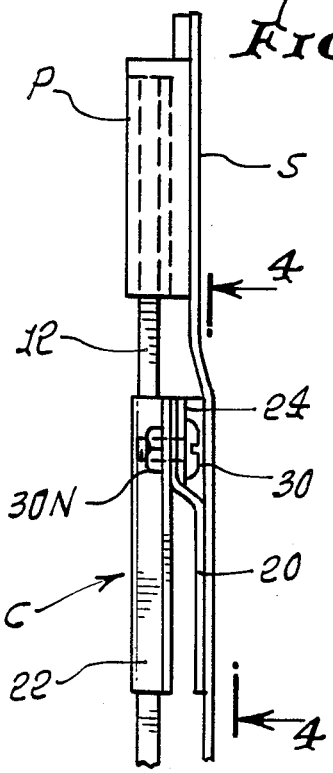

FIG. 4.
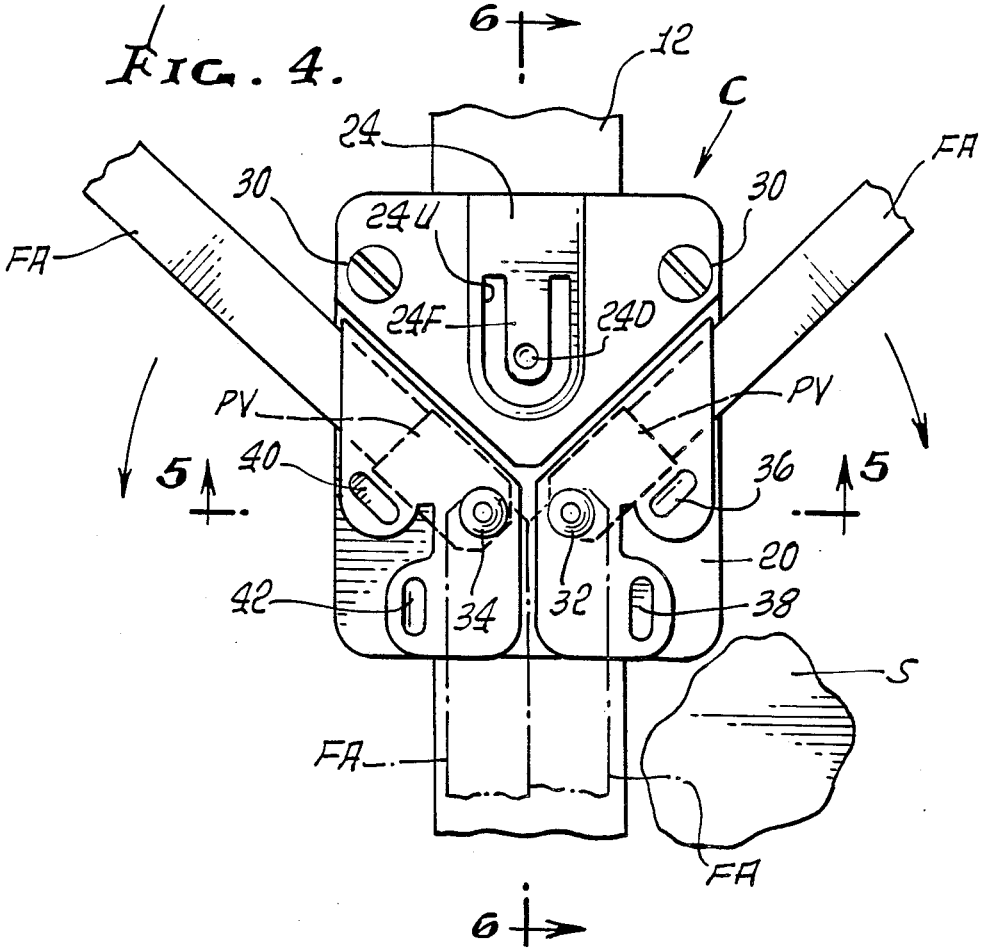
FIG. 5.
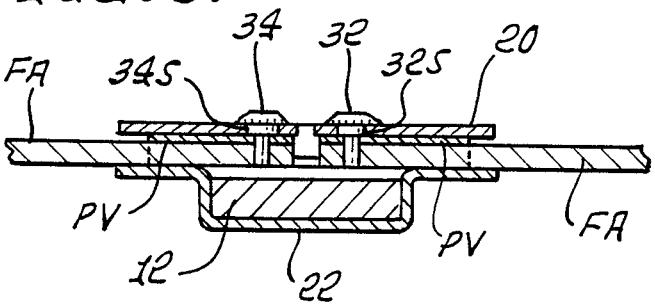
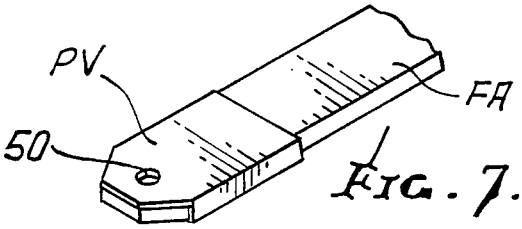
FIG. 7.
FIG. 6.
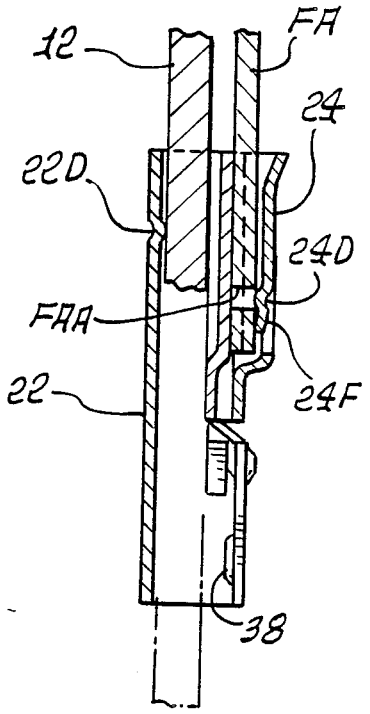

HIGHWAY SIGNS AND FLAGS CAPABLE OF BEING ROLLED UP

FIELD OF INVENTION

This invention relates to highway signs and more particularly to flexible, highways signs and flags capable of being disassembled and rolled up for convenience of storage and/or transport.

BACKGROUND OF INVENTION

Flexible, temporary highway signs for advance warning to a motorist of an approaching unsafe driving area or constrution site are well known in the art. The flexible highway signs are usually mounted on a stand permitting them to be assembled and disassembled at the point of use. The highway signs that are presently in use are generally provided with various highway legends for promoting the safe passage of motor vehicles and/or pedestrians in advising of an approaching unsafe driving area. The highways signs for this purpose are known to the art to flex in response to prevailing winds and wind gusts created by motor vehicles and/or the like, and are designed with springs to permit the signs to bend or flex with the winds without tipping over and to return to their normal message displaying positions when the winds decrease and/or subside. Highway signs are also provided with flags secured thereto for flapping in the winds for drawing additional attention of the motorist to the legend on the highway sign proper. Such temporary highway signs are known to the art to be constructed of flexible fabrics, such as a plastic mesh material constructed of a light-weight vinyl plastic and having fluorescent mesh material embedded therein. The use of fleixble, lightweight materials allow the sign per se to be readily rolled up for transport to another location or for storage once the reinforcing members that maintain the flexible sign in a message displaying position are removed therefrom. To avoid the use of bulky springs, reinforcing frame members for such flexible highway signs are presently used for holding the signs in a message display position and are constructed of flexible plastic materials that allow the sign and the reinforcing members to bend or their stand through a substantial angle, without tipping over in response to winds or wind gusts. The preferred form of device for securing the reinforcing frame members to the flexible sign is through the use of molded plastic corner members defining a socket for removably securing the ends of the frame members. Such an arrangement is disclosed in U.S. Pat. No. 4,426,800. This type of temporary highway sign corner pocket is commercially available from the Reflexite Corp. of New Britain, Connecticut. When the sign is so constructed, it can be rolled up around the disassembled frame members for ready storage or transport. Sign stands for mounting the flexible highway signs utilizing the corner pockets are also commercially available and are adapted for accommodating a single corner pocket for vertically mounting the sign. Highway flags are usually mounted in combination with the highway signs on flag arms to enhance the visibility of the highway signs, particularly to give advance warning at a distance. Despite these advancements in temporary highway sign structures, there is still a present need for an improved springless, wind-resistant sign that may be economically produced and capable of being readily assembled without fasteners, and when disassembled, have the sign and any flags thereon protected by rolling the sign around the frame and flag members for providing a compact bundle that may be readily transported and/or stored. Such a bundle takes up a minimum of space on trucks for transport purposes. It is also desired to provide such a sign that is stable with the winds and wind gusts that are effective, without the need for resorting to ballasting with sandbags or the like for the sign proper, as is required in some present day structures.

SUMMARY OF INVENTION

The present invention provides an improved, inexpensive highway sign, stand and flags that can be quickly assembled together and disassembled without the use of fasteners, tools or special skills. The invention, in particular, is an improved highway sign constructed of a lightweight plastic reflective material and flexible frame members for holding the sign in a highway message displaying position and yet is responsive to winds and wind gusts without tipping over and is capable of returning to its display position without being distorted or taking a set due to the flexibility of the selected frame members for the highway sign. The frame members include an improved clamping means for mounting one, two or three flags thereon by simply pushing the flag's arm into the display position. Two of the flags are capable of being pivoted from the display position to a storage position, while the third flag may be removed from the clamping means for storage and transportation. The flexible frame members for holding the highway sign in a display positlon are detachable from the sign and the flexible flag arms can be pivoted to a storage position to permit the flag arms to lie side-by-side with the folded frame members. The flexible sign may then be rolled around the frame members and flag arms for storage and transport, thereby occupying a minimum amount of space in a warehouse, motor vehicle, truck, trailer, or the like. In subsequent use, the frame members can be reassembled to the highway sign, inserted in a sign stand and the flags pivoted to a display position for further use.

From a broad structural standpoint the present invention comprises a flexible highway safety sign having a message panel recorded thereon and having a preselected configuration and adapted to be reinforced to be held in a substantially flat message displaying position. The reinforcing means are removably secured to the non-message side of the message panel for maintaining the panel in a message display position when secured thereto. The reinforcing means includes at least a single reinforcing member secured to the message panel. Clamping means are provided and are secured to the single reinforcing member adjacent one end thereof. The clamping means is constructed and defined for pivotally securing at least a single flag arm between a flag displaying position extending outwardly of the sign message panel from one side thereof and pivotable to a storage position to lie alongside reinforcing members to allow the reinforcing members and flag arms to be bundled up and wrapped with the flexible highway safety sign for easy transport.

From the standpoint of a clamping assembly for flag arms useful with a flexible highway sign, the clamping assembly includes a pivot plate having a pair of spaced sections for pivotably individually securing a flag arm to each of the sections. Each section a pivot pin secured thereto and arranged in horizontal lignment with one another. The pivot plate includes a third section arranged at a different and higher elevation than the pair of sections carrying the pivot pins and arranged adjacent the ends of the sections, with a bridging portion extending between the third section and the individual ones of said pair of sections for arresting the upward movement of a flag arm pivotably secured to the individual pivot pins. Each pair of section includes at least a single upstanding element arranged on the section in spaced relationship to the associated pivot pin and bridging portions of the third section for confining the end of a flag arm pivotably secured to the pivot pin to a flag displaying position. The pivot plate is further characterized as being yieldable to forces applied to the flag arm to cause the flag arm to move over the upstanding element for positioning the flag arm in a non-displaying position. The clamping assembly includes a mounting plate adapted to be secured to a sign frame member and to the pivot plate for clamping the frame member therebetween. The mounting plate overlies the pivot plate on the side having the pivot pins and is secured to the pivot plate at the third section, thereby permitting a flag arm to extend upwardly of the secured plates to permit the pivotal movement of the flag arm. The assembly is completed by fastening means for securing the mounting plate and pivot plate together.

BRIEF DESCRIPTION OF THE DRAWINGS

These and other features of the present invention may be more fully appreciated when considered in the light of the following specification and drawings, in which:

FIG. 1 is a front elevational view of the highway safety sign mounted on a sign stand and illustrating three flag arms with secured thereto and embodying the present invention;

FIG. 2 is a partial, rear elevational view of the highway safety sign of FIG. 1 with the third flag arm detached;

FIG. 3 is a cross sectional view, with portions shown in dotted outline, taken along the line 3—3 of FIG. 2;

FIG. 4 is a sectional view of the clamping assembly taken along the line 4—4 of FIG. 3, with the ends of the two flag arms broken off and illustrating the two flag arms in storage position in dotted outline;

FIG. 5 is a cross-sectional view through the clamping assembly taken along the line 5—5 of FIG. 4;

FIG. 6 is a cross-sectional view taken along the line 6—6 of FIG. 4; and FIG. 7 is a partial, perspective view of a detached flexible flag arm.

DETAILED DESCRIPTION OF THE PREFERRED EMBODIMENT

Now referring to the drawings, the presently preferred embodiment of the highway sign 10 will be described. The highway sign 10 is illustrated in FIG. 1 as comprising a sign stand ST of known commercial configuration that may be readily folded for transport and unfolded for mounting a highway sign S thereon, as illustrated in the drawings. The traffic stand ST is particularly adapted to secure the sign S by means of one of its corner pockets for readily mounting and unmounting the sign S to the stand ST. The highway sign S per se carries a highway safety legend of a preselected type on one side thereof and one such exemplary legend is illustrated in FIG. 1 on the front face thereof. Reinforcing members are arranged on the opposite side of the signs for holding the sign in the illustrated message displaying position. The backside of the signS carries the sign reinforcing members 12 and 14; see FIG. 2. Reinforcing member 12 arranged on the backside of the highway sign S carries the clamping member C for pivotably mounting flag arms having highway flags secured thereto. The flags are identified by the letter F and are secured to the flag arms FA.

Now referring to the highway sign S per se, it should be noted that the signs per se are of commercially available construction and utilize a lightweight, flexible material, such as reflective vinyl plastic and a fluorescent mesh that allows the sign to be readily rolled up, and in this condition, keeps the sign faces and legends in good working order. The signs may be sized as 36 inches by 36 inches, or 48 inches by 48 inches, in size. In order to maintain the sign S in a message displaying position, reinforcing or frame members are provided for the backside of the sign S, as best illustrated in FIG. 2. The reinforcing frame members are identified as the elements 12 and 14 which are pivotably secured at their center points by a fastener 15. The reinforcing frame members 12 and 14 are preferably constructed of a flexible material that will allow the secured sign S to respond to the winds or wind gusts impinging thereon by bending, without breaking or tipping over, and returning to its original position without taking a set. One type of reinforcing member that is found useful for this purpose is glass reinforced polyester, plastic pulltrusions that are commercially available. The glass reinforcing allows the frame members to bend through approximately a 90 degree angle without breaking and to spring back to their original position. The pivotable securement of the members 12 and 14 allows them to be pivoted to a side-by-side relationship when detached from the sign S. The frame members 12 and 14 are arranged to be secured to the sign S by means of corner pockets P secured to each of the four corners of the sign S. The corner pockets P are of a commercially available construction and are disclosed in U. S. Pat. No. 4,426,800. The type of corner pocket that is described in this patent is commercially available from the Reflexite Corp. at 315 South Street, New Britain, Connecticut 06050. Basically the corner pockets comprise polycarbonate elements P that define a socket having a single open end for receiving one end of the frame members 12 and 14. The front side of the sign is provided with a reinforcing member R of the size and shape to conform with the pocket P and which reinforcing member R is secured to the front sides of the sign wherein the two elements sandwich the corner of the sign S proper therebetween without causing damage to the sign S. When the four corner pockets are arranged as illustrated in FIG. 2, the ends of the frame members 12 and 14 can be pivoted to an open position and bent so as to be secured in the pockets P on opposite corners of the sign S for maintaining the sign in a message displaying position, as illustrated in FIGS. 1 and 2. The vertical frame member 12 secures a clamping member C for mounting the highway flags to extend outwardly of the sign S proper. The clamping member C is also constructed and defined for releasably securing a third flag F extending vertically outwardly in alignment with the frame member 12, as illustrated in FIGS. 1 and 6.

Now referring to FIGS. 3 through 7, the details of the clamping member C will be described in detail. The clamping member C basically consists of three elements. The three elements are the pivot plate 20, the back plate 22 and the quick flag plate 24. The pivot plate 20 is essentially of the same length as the back plate 22, as illustrated. The flag plate 24 overlies the top portion of the pivot plate 20 at the top end thereof, as illustrated in FIGS. 4 and 6, and the three plates are secured together by fasteners 30 through the provision of suitable apertures in the three plates. The back plate 22 has a U-like configuration for accommodating the width of the vertical reinforcing member 12, as illustrated. No fasteners are utilized for securing the frame member 12 to the back plate, and is best illustrated in FIG. 6, is clamped to the frame member 12 by means of the inwardly extending dimple 22D which will penetrate the member 12 when the fasteners 30 are properly secured by the nuts for securing the clamping member C to a preselected position on the frame member without splitting the frame members. The fasteners 30 have suitable nuts 30N threaded to the ends thereof to secure the three plates together.

Referring specifically to FIG. 4, it will be noted that the pivot plate 20, as illustrated therein, is defined with two elevations, with the lower elevation arranged adjacent the top end thereof and has inwardly extending inclined portions accommodating the complementary configured edges of the flat plate 24 in the lower elevation. The pivot plate 20 has bridging portions extending along the inclined portions for bridging the two elevations of the pivot plate 20. The lower section of the pivot plate 20 has a pair of pivot pins 32 and 34 staked to the frontside thereof. The pivot pins 32 and 34 are both identically constructed and have a shoulder that is mounted in a cavity on the front side of the plate. The shoulders are identified in FIG. 5 as the shoulders 32S and 34S. The depth of the cavity for the pivot pins 32 and 34 is defined to cause the top face of the shoulders 32S and 34S to be at the same level with the adjoining sections of the pivot plate 20 for slidably accommodating a flag arm FA for allowing it to slidably travel over the pivot plate proper and the shoulders 32S and 34S. The pivot pins 32 and 34 preferably comprise a hollow rivet extending from their respective shoulders, as illustrated in the drawings. The bottom section of the pivot plate 20 is bifurcated at the center to define two sections. The rivets 32 and 34 are secured to an individual section of the plate 20 and in horizontal alignment, as illustrated. Each section of the pivot plate 20 is also provided with a pair of upstanding members or dimples that have been formed from the frontside of the pivot plate 20. On the right hand section of the pivot plate 20, as illustrated in FIG. 4, there are formed the dimples 36 and 38 extending inwardly, while the left hand similarly forms the dimples 40 and 42. The pivot plate 20 and the remaining elements of the clamping member C are preferably heat treated and formed of stainless steel to cause the plates to exhibit a spring-like characteristic to allow them to yield when force is applied thereto.

The pivot pins 32 and 34 each mount a flag arm FA through the provision of a mounting aperture adjacent the end of each of the flag arms FA. The flag arms FA are preferably constructed of a pulltruded glass reinforced polyester plastic of the same type as employed for the frame members 12 and 14. In this instance, the pivotable ends of the flag arms FA are provided with a pivoting stainless steel clip PV secured to three sides of the flag arms FA (see FIG. 7) to act as a bearing surface when the flag arms are pivoted between the flag displaying position, such as illustrated in FIG. 4, and the storage position that is illustrated in the same drawing in dotted outline. The pivot clip PV is provided with an aperture 50 coaxial with the aperture for the flag arm FA. The pivot clip PV is defined so that when force is applied to the flag arm FA by a user pulling on the arm to place it in the storage position, for example, the clip PV is defined to have sufficient structural strength to carry the pulling load as it is moved downwardly and slides on the surface of the pivot plates 20. Due to the spring-like characteristics of the pivot plate 20, the flag arm FA will ride over the top of the dimple 36 by means of the clip PV, and when the arm moves beyond the dimple 36, the plate 20 will spring back into its normal position. Similarly, as the arm engages the lower dimple 38, the applied force will cause the plate 20 to yield and allow the flag arm FA to move over the dimple 38 to assume a vertically aligned storage position with the frame member 12, as illustrated. The same action occurs with regard to the flag arm FA on the other side of the plate 20 with respect to the dimples 40 and 42. Similarly, in moving the flag arms FA from the storage to the flag displaying position, the same pivotal movement occurs. It should be noted that the dimples 36 and 40 are spaced on the segments of the pivot plate 20 so that when the flag arms FA are each arranged in the flag displaying position, the upper edges of the flag arms will be confined by the bridging portion of the pivot plate 20 and the dimples 36 and 40 to hold the flag arm in the flag displaying position, as is evident from FIG. 4. Similarly, the dimples 38 and 42 will maintain the flag arms FA in their storage position.

The flag plate 24 is adaptad to releasably accept a third flag arm FA in a flag holding socket defined integrally with the plate. The flag plate 24 has defined intermediate its ends three sides of a socket with the front side having a finger-like element 24F that is defined by a U-shaped aperture 24U adjacent the lower end of the socket, as illustrated. The finger 24F has an inwardly extending detent 24D for engaging the flag arm FA. Since the flag arm FA secured in the flag plate 24 does not pivot but merely slips into and out of the holding socket, it is not provided with a pivot clip PV but merely a securing aperture FAA for coactive engagement with the dimple 24D; see FIG. 6. The flag arm FA is accommodated by the socket defined in the flag plate 24 and the shaped top side of the pivot plate to provide sufficient opening for slidably receiving the flag arm therein. The flag arm FA is mounted by pushing it into the thus defined socket until the end of the arm passes beyond the dimple 24D and the dimple engages the holding aperture FAA in the flag arm for securing it in a flag displaying position. For storage purposes the flag arm FA can be released by pulling it upwardly away from the dimple 24D and then stored in combination with the flag arm FA and the frame members 12 and 14.

We claim:

1. A flexible, highway safety sign capable of being rolled up for storage and portability and mounting a highway flag comprising a flexible message panel having a quadrilateral configuration capable of being rolled up for storage or transportation and rolled open to assume a substantially flat message displaying configuration, bracket means secured adjacent each corner of said message panel, the bracket being constructed and defined with individual sockets for receiving and removably securing an end of each of a pair of flexible sign cross-members on one side of the panel, a pair of flexible sign cross-members pivotally secured to one another intermediate their ends for permitting the members to be pivotably folded between a side by side position, and to be pivotaly unfolded to an orthogonally related open relationship, one end of each of said cross-members being removably mounted in an individual socket for the flexible message panel to cause the message panel to assume a substantially flat message displaying configuration, the cross-members being constructed and defined with sufficient stiffness to normally maintain the flexible meassage panel in an upright message displaying position and yet sufficiently flexible to be flexibly responsive to winds and wind gusts impinging thereon to tilt in accordance with the strength of said winds without breaking or becoming physically distorted and to return to its upright position upon the cessation or dimunition of the winds or wind gusts, and clamping means secured to one of said cross-members adjacent to one corner thereof and secured in a preselected position on said one cross-member without fasteners extending through the cross-member, said one cross-member being secured to said individual sockets for positioning the clamping means adjacent one corner of said message panel when the cross-members hold the message panel in a flat message displaying configuration, said clamping means being constructed and defined for pivotally securing at least a first flag arm in a flat displaying position extending outwardly of said message displaying panel from one side thereof and pivotable to a storage or portability position aligned side by side with the folded cross-members thereby allowing the flexible message panel to be rolled around the cross-members and flag arm when said panel is detached from the cross-members, said clamping means comprises a pivot plate having first and second spaced sections for pivotably, individually securing a flag arm to each of said sections, each section having a pivot pin secured thereto so that the pivot pins are arranged on each section in alignment with one another, the pivot plate including a third section arranged at a different elevation than said first and second sections adjacent the ends of said first and second sections securing the pivot pins and having a pair of bridging portions extending between said third section and an individual one of said first and second sections for arresting the movement of a flag arm pivotably secured to the individual pivot pin of one of the first and second sections, each of said first and second sections including at least a single upstanding element arranged on the first and second sections including at least a single element arranged on the first and second sections in spaced relationship to the pivot pin and said arresting portions of the third section for confining the end of a flag arm secured to the pivot pin to a flag displaying position, said pivot plate being further characterized as being yieldable to forces applied to a flag arm secured to a pivot pin to cause the flag arm to move over the upstanding element for positioning the flag arm in a non-displaying position, and a mounting plate adapted to be secured to said one cross-member and to the pivot plate for clamping the cross-member therebetween, the mounting plate overlying the pivot plate on the side thereof having the pivot pins and secured to the pivot plate at said third section, thereby permitting a flag arm to extend outwardly of the secured plate to permit said pivotal movement of a flag arm secured to either pivot pin, and fastening means for securing the mounting plate and pivot plate together.

2. A flexible highway safety sign as defined in claims 1 wherein the cross-members and flag arm(s) are constructed of a pulltruded, glass reinforced plastic.

3. A flexible, highway safety sign as defined in claim 1 or 2 wherein said bracket means comprises a molded socket secured to said message panel on one side thereof and a reinforcing member secured to the other side of the message panel and sandwiching the message panel therebetween.

4. A flexible, highway safety sign as defined in claim 1 wherein said bracket means comprises a molded socket secured to said message panel on one side thereof and a reinforcing member secured to the other side of the message panel and sandwiching the message panel therebetween, including a foldable sign stand constructed and defined to assume an upright sign mounting position and adapted to receive and secure one of said molded sockets for releasably mounting the flexible message panel in an upright position.

5. A flexible, highway safety sign as defined in claim 1 wherein each of said spaced sections include another upstanding element defined thereon in spaced relationship with said single element and the adjacent pivot pin to permit a flag arm positioned beyond said single element to be yieldably moved over said another element in response to forces applied to a flag arm to cause the flag arm to be restrained between the pivot pin and said another element on said section in a storage position related to the flag displaying position and yet pivotably movable over said upstanding elements to the flag displaying position.

6. A flexible, highway safety sign as defined in claim 1 wherein the flag arm is constructed as a pull-trusion of glass reinforced polyester plastic material having two ends and a pivoting aperture spaced adjacent one one of said ends for interfitting with said pivot pin and a metallic clip having a pivot pin aperture co-axially secured with said pulltrusion aperture and functioning as a bearing surface for the pivotal movement of the flag arm.

7. A clamping assembly as defined in claim 1 wherein said pivot plate is constructed of a heat treated stainless steel.

8. A clamping assembly as defined in claim 1 wherein said mounting plate is constructed and defined with a preselected socket with the pivot plate for accommodating frame members of different sizes.

9. A flexible highway safety sign comprising a flexible highway message panel having a preselected configuration and adapted to be reinforced to be held in a substantially flat, message displaying position when reinforced, reinforcing means removably secured to the nonmessage side of the message panel for maintaining the panel in a message displaying position when secured thereto, said reinforcing means including at least a single reinforcing member secured to said message panel, clamping means secured to said single reinforcing member adjacent one end thereof, the clamping means being secured to said reinforcing member without any fasteners being secured thereto and without causing the splitting of said member, said clamping means being constructed and defined for pivotably securing at least at least a single flag arm between a flag displaying position extending outwardly of said message panel from one side thereof and pivotable to a storage position alongside said single reinforcing member, said at least a single flag arm pivotally secured to said clamping means whereby when the reinfocing means is removed from the message panel and the flag arm is pivoted to a storage position it may be readily stored and transported, and said reinforcing means and flag arm are constructed of glass reinforced polyester pulltrusion material, said clamping means is constructed and defined for pivotably securing a pair of flag arms for pivotal extension from opposite sides of the message panel and pivotably movable to a storage or transport position, and a third flag arm removably secured to said clamping means.

10. A clamping assembly for flag arms useful with a flexible highway sign having at least a single frame member, comprising a pivot plate having a pair of spaced sections for pivotably, individually securing a flag arm to each of said sections, each section having a pivot pin secured thereto so that the pivot pins are arranged on each section in alignment with one another, the pivot plate including a third section arranged at a different elevation than said pair of sections adjacent the ends of said sections securing the pivot pins and having a pair of bridging portions extending between said third section and an individual one of said pair of sections for arresting the movement of a flag arm pivotably secured to the individual pivot pin, each of said pair of sections including at least a single upstanding element arranged on the section in spaced relationship to the pivot pin and said arresting portions of the third section for confining the end of a flag arm secured to the pivot pin to a flag displaying position, said pivot plate being further characterized as being yieldable to forces applied to a flag arm secured to a pivot pin to cause the flag arm to move over the upstanding element for positioning the flag arm in a non-displaying position, and on a mounting plate adapted to be secured to said frame member and to the pivot plate for clamping the frame member therebetween, the mounting plate overlying the pivot plate on the side thereof having the pivot pins and secured to the pivot plate at said third section, thereby permitting a flag arm to extend outwardly of the secured plates to permit said pivotal movement of a flag arm secured to either pivot pin, and fastening means for securing the mounting plate and pivot plate together.

11. A clamping assembly for flag arms as defined in claim 10 wherein each of said spaced sections includes an additional upstanding element defined thereon in spaced relationship with said at least single upstanding element and the adjacent pivot pin to permit a flag arm positioned beyond said single element to be yieldably moved over said additional element in response to forces applied to a flag arm to cause the flag arm to be restrained between the pivot pin and said additional element on said section in a storage position relative to the flag displaying position and yet pivotably movable over said upstanding elements to the flag displaying position.

12. A clamping assembly for flag arms as defined in claim 10 wherein the flag arm is constructed as a pulltrusion of glass reinforced polyester plastic material having a pivoting aperture spaced adjacent one end for interfitting with said pivot pin and a metallic clip having a pivot pin aperture co-axially secured with said pulltrusion aperture and functioning as a bearing surface for the pivotal movement of the flag arm.

13. A clamping assembly for flag arms as defined in claim 10 including a third plate constructed and defined to be mounted to overlie the opposite side of said third section of the pivot plate from said mounting plate and secured to the mounting plate and pivot plate by said fastening means, said third plate defining a socket with the adjacent side of the pivot plate when secured thereto for releasably securing a flag arm therein.

14. A clamping assembly for flag arms as defined in claim 13 wherein said socket is constructed and defined to include a spring-like element for releasably securing a flag arm thereto.

15. A clamping assembly for flag arms as defined in claim 14 wherein said third plate is shaped to abut said bridging portions and to be seated thereagainst when the plates are secured together, the flag arm for said socket being constructed as a pulltrusion of a glass reinforced polyester plastic material having securing means defined thereon for releasable co-action with said spring-like element.

16. A clamping assembly for flag arms as defined in claim 15 wherein the securing means for each of the flag arms comprises an aperture spaced adjacent an end of each of the arms and the spring-like element includes a dimple means for securement of the arms in said apertures for releasably holding the flag arms.

* * * * *

UNITED STATES PATENT AND TRADEMARK OFFICE

CERTIFICATE OF CORRECTION

PATENT NO. : 4,980,984

DATED : January 1, 1991

INVENTOR(S) : Jack H. Kulp et al

It is certified that error appears in the above-identified patent and that said Letters Patent is hereby corrected as shown below:

In the Abstract, line 13, "wreapped" should read -- wrapped --.

Column 1, line 44, "or" should read -- on --.
Column 2, line 67, after "section" and before "a", insert -- has --.
Column 3, line 34, after "with" and before "secured", insert --flags--.
Column 6, line 30, "adaptad" should read -- adapted --.
Column 8, line 5, "2" should read -- 4 --.

Signed and Sealed this

Twenty-first Day of July, 1992

*Attest:*

DOUGLAS B. COMER

*Attesting Officer*

*Acting Commissioner of Patents and Trademarks*